US009243474B2

(12) United States Patent
Zhang et al.

(10) Patent No.: US 9,243,474 B2
(45) Date of Patent: Jan. 26, 2016

(54) USING DYNAMIC UNDERBALANCE TO INCREASE WELL PRODUCTIVITY

(71) Applicant: Halliburton Energy Services, Inc., Houston, TX (US)

(72) Inventors: Wei Zhang, Carrollton, TX (US); Mark S. Holly, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/414,454

(22) PCT Filed: Apr. 2, 2014

(86) PCT No.: PCT/US2014/032624

§ 371 (c)(1),
(2) Date: Jan. 13, 2015

(87) PCT Pub. No.: WO2015/152907

PCT Pub. Date: Oct. 8, 2015

(65) Prior Publication Data

US 2015/0337629 A1 Nov. 26, 2015

(51) Int. Cl.

| | |
|---|---|
| ***E21B 43/114*** | (2006.01) |
| ***E21B 43/25*** | (2006.01) |
| ***E21B 37/00*** | (2006.01) |
| ***E21B 34/06*** | (2006.01) |
| *E21B 21/00* | (2006.01) |

(52) U.S. Cl.

CPC ..... *E21B 37/00* (2013.01); *E21B 34/063* (2013.01); *E21B 43/114* (2013.01); *E21B 43/25* (2013.01); *E21B 2021/006* (2013.01)

(58) Field of Classification Search

CPC ..... E21B 37/00; E21B 37/08; E21B 27/00; E21B 2021/006; E21B 21/00; E21B 34/063; E21B 34/14

See application file for complete search history.

(56) References Cited

U.S. PATENT DOCUMENTS

| | | | | | |
|---|---|---|---|---|---|
| 4,557,331 | A * | 12/1985 | Stout | E21B 34/063 | 166/297 |
| 4,805,726 | A * | 2/1989 | Taylor | G01V 1/52 | 181/106 |
| 7,243,725 | B2 * | 7/2007 | George | E21B 43/1195 | 166/297 |

(Continued)

FOREIGN PATENT DOCUMENTS

| | | | | |
|---|---|---|---|---|
| WO | 2013073948 | A1 | 5/2013 | |
| WO | WO 2015060818 | A1 * | 4/2015 | E21B 37/10 |
| WO | 2015152907 | A1 | 10/2015 | |

OTHER PUBLICATIONS

International Search Report and Written Opinion for PCT/US2014/032624 dated Dec. 24, 2014.

*Primary Examiner* — Daniel P Stephenson

(74) *Attorney, Agent, or Firm* — McDermott Will & Emery LLP; Scott Brown

(57) ABSTRACT

An example underbalance pressure generator device includes a housing having a first end, a second end, and an implosion chamber between the first and second ends, one or more influx ports defined in the housing and enabling fluid communication between the implosion chamber and an exterior of the housing, at least one frangible member fixedly attached to the housing such that a pressure differential can be generated across the at least one frangible member between the implosion chamber and the exterior of the housing, and an actuation device within the housing and configured to rupture the at least one frangible member upon being triggered.

18 Claims, 5 Drawing Sheets

(56) References Cited

U.S. PATENT DOCUMENTS 8,136,608 B2 * 3/2012 Goodman ..... E21B 43/1195 166/297
9,080,430 B2 * 7/2015 Al Busaidyab ..... E21B 43/114
2004/0231840 A1 11/2004 Ratanasirigulchai et al.
2005/0217854 A1 10/2005 Hayes et al.
2006/0201371 A1 * 9/2006 Li ..... F42B 1/024 102/307
2006/0219409 A1 10/2006 Dyer
2008/0105430 A1 * 5/2008 Cuthill ..... E21B 43/1195 166/297
2010/0300690 A1 12/2010 Al Busaidy
2014/0076564 A1 * 3/2014 Rodgers ..... E21B 43/116 166/298
2014/0262503 A1 * 9/2014 Rodgers ..... E21B 41/0092 175/2

* cited by examiner

USING DYNAMIC UNDERBALANCE TO INCREASE WELL PRODUCTIVITY

BACKGROUND

The present disclosure relates to wellbore operations and, more particularly, to using non-explosive, dynamic underbalancing techniques to increase fluid flow within a wellbore.

After drilling various sections of a subterranean wellbore that traverses a hydrocarbon-bearing formation, a well operator may undertake perforation operations to increase productivity in one or more sections of the wellbore. The increased productivity resulting from perforation operations may slow over time due to the perforation channels gradually becoming obstructed through the buildup of sand, wax, scale, and other common wellbore debris.

There are currently many ways to treat a well to counteract the buildup of wax or scale in wellbore perforation channels. In some cases, for instance, a well may be acidized or additional hydraulic fracturing may be undertaken. In other cases, the production zones may be re-perforated using additional downhole wellbore explosives. The resulting explosions generated by the downhole explosives create a dynamic underbalance in the wellbore at the corresponding production zones, which results in a dynamic underbalance and pressure differential generated between the wellbore and the surrounding formation. Thus, upon detonating downhole explosives adjacent the production zone, rapid decompression occurs and wax, scale and/or debris within the perforation channels are drawn into the wellbore and can then be circulated to the surface for removal. This process, however, is inherently dangerous due to the need to use and store downhole explosives around a rig site.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to wellbore operations and, more particularly, to using non-explosive, dynamic underbalancing techniques to increase fluid flow within a wellbore.

The present disclosure provides improved systems and methods for increasing fluid flow within a wellbore using dynamic underbalancing techniques. An underbalance pressure generator device is used to create an underbalance in the wellbore and thereby draw scale and debris out of perforation channels formed in the surrounding wellbore and into the surrounding annulus. The underbalance pressure generator device includes one or more frangible members that may be pierced or otherwise ruptured with an actuation device to create the required underbalance within the wellbore. The frangible members may be either axially or radially disposed within the underbalance pressure generator device. A distinguishing feature of the underbalance pressure generator device is the lack of need for explosives, thus making the operation safer for rig personnel.

Figure 1:
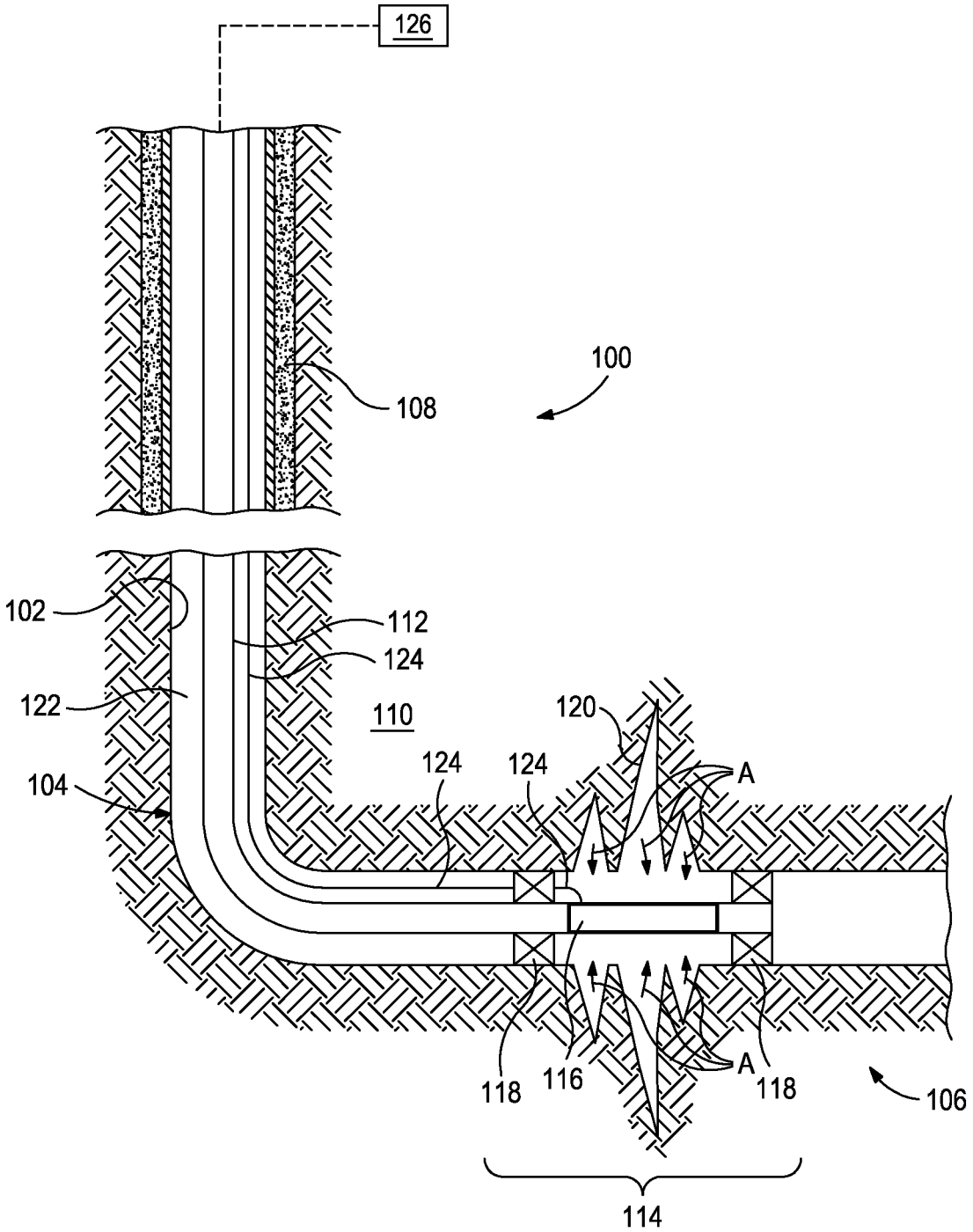
FIG. 1 is a diagram that illustrates a well system that may embody or otherwise employ one or more principles of the present disclosure, according to one or more embodiments.

Referring to FIG. 1, illustrated is an exemplary well system 100 that can embody or otherwise employ one or more principles of the present disclosure, according to one or more embodiments. As depicted, the well system 100 includes a wellbore 102 that extends through various earth strata and has a substantially vertical section 104 that transitions into a substantially horizontal section 106. The upper portion of the vertical section 104 may have a liner or casing string 108 cemented therein, and the horizontal section 106 may extend through a hydrocarbon bearing subterranean formation 110. As illustrated, the horizontal section 106 may be an open hole section of the wellbore 102. In other embodiments, however, the horizontal section 106 of the wellbore 102 may be completed, without departing from the scope of the disclosure.

The system 100 may further include a tool string 114 coupled or otherwise attached to a conveyance 112 that extends from the surface (not shown). The conveyance 112 may be, but is not limited to, drill pipe, production tubing, wireline, slickline, an electric line, coiled tubing, combinations thereof, and the like. In some embodiments, the tool string 114 may be pumped downhole to a target location within the wellbore 102 using hydraulic pressure applied from the surface. In other embodiments, the tool string 114 may be conveyed to the target location using gravitational or other natural forces.

The tool string 114 may include one or more downhole tools, such as an underbalance pressure generator device 116 (hereafter "the device 116"). As will be described in greater detail below, the device 116 is capable of generating a dynamic underbalance within the wellbore 102 that may facilitate the removal of sand, wax, scale, and/or other wellbore debris from one or more perforation channels 120 defined in the walls of the wellbore 102 and extending into the subterranean formation 110. In some embodiments, the tool string 114 may include additional downhole tools, such as one or more packers 118 or other types of wellbore isolation devices that may provide a fluid seal between the tool string 114 and the wellbore 102, thereby defining corresponding production intervals or zones between axially adjacent packers 118.

During operation, as illustrated, the device 116 may be positioned at or near the perforation channels 120 and between the packers 118. While only two downhole tools 116, 118 are shown, those skilled in the art will readily appreciate that additional downhole tools may be included in the tool string 114, without departing from the scope of the disclosure. For instance, in at least one embodiment, as will be discussed below, the tool string 114 may further include a jarring tool, such as a spang jar or the like, used to actuate or otherwise activate the device 116 for operation.

A control line 124 may extend within the wellbore 102 from a surface location, such as a wellhead or service rig (not shown), to the tool string 114. As depicted, the control line 124 may extend downhole within an annulus 122 defined between the inner wall of the wellbore 102 and the conveyance 112 and, in at least one embodiment, may extend through one of the packers 118 to access the device 116. In other embodiments, however, the control line 124 may extend within the conveyance 112. The control line 124 may be configured to provide surface communication to the tool string 114 and, more particularly, to the device 116.

While only one control line 124 is depicted, it will be appreciated that numerous control lines used for varying purposes are contemplated herein as forming part of the well system 100. Indeed, the control line 124 may be representative of or otherwise include one or more hydraulic lines, one or more electrical lines, and/or one or more fiber optic lines that extend from the surface location to the tool string 114.

In exemplary operation, the device 116 may be advanced into the wellbore 102 to a target location where increased hydrocarbon productivity is desired, such as at or adjacent the pre-made or pre-perforated perforation channels 120. The device 116 may then be actuated or otherwise activated in order to generate a pressure underbalance within the annulus 122 surrounding the device 116. In some embodiments, the device 116 may be actuated from the surface, such as via one or more commands sent to the device 116 via a computer 126 arranged at the surface location. In other embodiments, however, the device 116 may be actuated using downhole equipment, as described below.

Upon generating the pressure underbalance in the annulus 122, wax, scale, and/or other wellbore debris that may be present within the perforation channels 120 may be dislodged and otherwise drawn into the annulus 122, as depicted by the arrows A, and thereby clearing (or substantially clearing) the perforation channels 120 of such debris and scale. In one embodiment, some or all of the debris and scale may be returned to the surface via the annulus 122 under pressure after the tool string 114 is pulled back uphole. In other embodiments, a portion of the debris and scale may be drawn or otherwise flow into the device 116 and returned to the surface when the tool string 114 is removed from the wellbore 102.

The computer 126 may include a processor and a machine-readable storage medium having instructions stored thereon, which, when executed, may perform operations in real-time or near real-time such as communicating and/or controlling the downhole tools. For instance, the computer 126 may operate the packers 118 and thereby define the production interval, or actuate the device 116 and thereby clear scale and/or debris from the perforation channels 120. As discussed below, the computer 126 may be part of a broader neural network, enabling operation or monitoring from an offsite location.

Even though FIG. 1 depicts the tool string 114 as being arranged in a generally horizontal section 106 of the wellbore 102, those skilled in the art will readily recognize that the principles of the present disclosure are equally well suited for use in vertical or deviated portions of wells. As used herein, directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
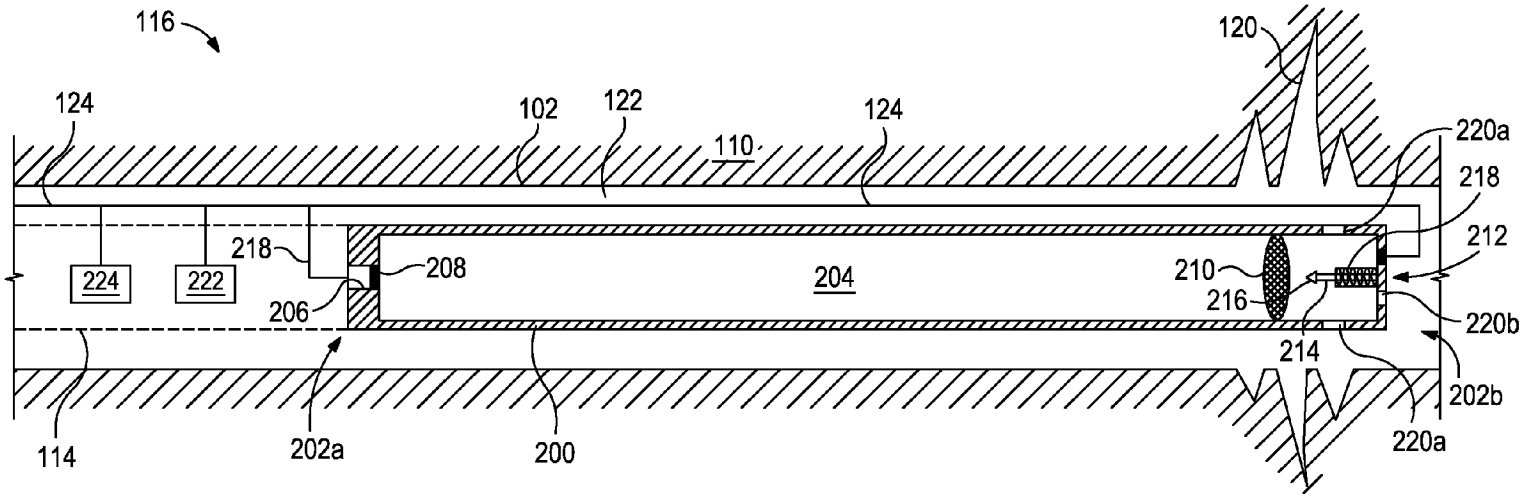
FIGS. 2A and 2B are diagrams that illustrate an embodiment of the exemplary underbalance pressure generator device of FIG. 1, according to one or more embodiments.
Figure 2B:
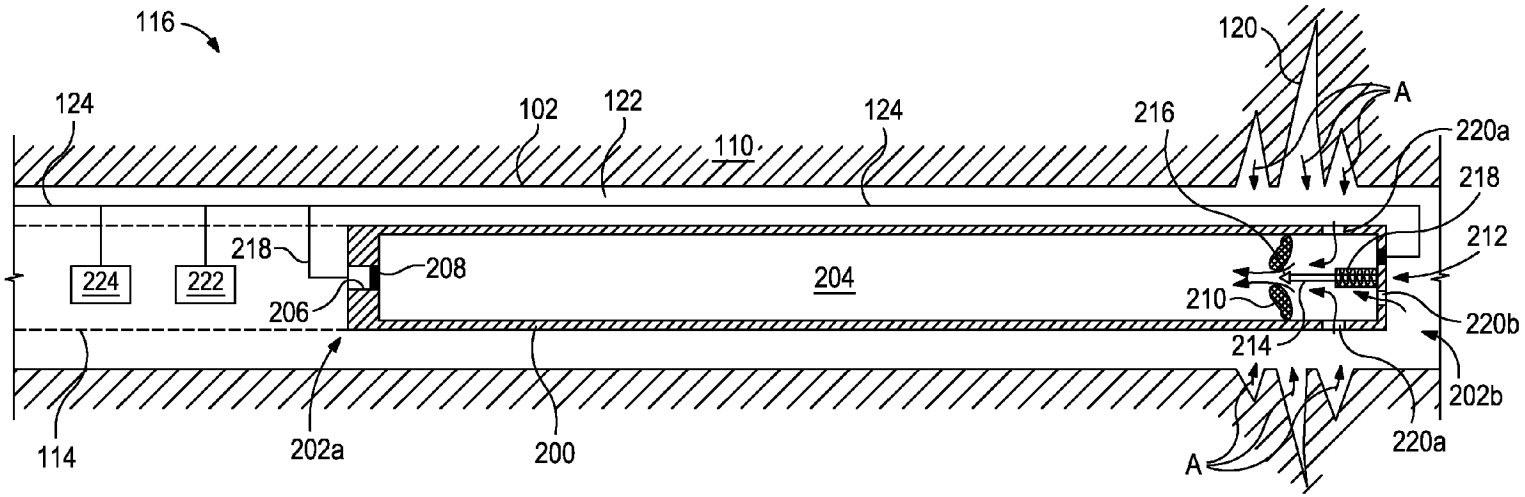

Referring now to FIGS. 2A and 2B, illustrated are enlarged cross-sectional side views of the exemplary underbalance pressure generator device 116 of FIG. 1, according to one or more embodiments. More particularly, FIG. 2A depicts the device 116 prior to its actuation, and FIG. 2B depicts the device 116 following its actuation. The device 116 may include a housing 200 having a first end 202*a* and a second end 202*b*. In one embodiment, the housing 200 may be generally cylindrical and define an implosion chamber 204 between the first and second ends 202*a,b*.

A fluid port 206 may be provided or defined at or near the first end 202*a* of the housing 200. The fluid port 206 may enable fluid communication between the implosion chamber 204 and a low-pressure source (not shown) via a conduit 218 operatively coupled to the fluid port 206. The low-pressure source may be any device or mechanism configured to reduce the fluid pressure within the implosion chamber 204 including, but not limited to, a vacuum, a compressor, a pump, or any combination thereof. In at least one embodiment, a one-way check valve 208 may be disposed within the fluid port 206 and configured to allow fluids to exit the implosion chamber 204 via the fluid port 206 and simultaneously prevent fluids from entering the implosion chamber 205 via the fluid port 206.

In one embodiment, the conduit 218 may be fluidly coupled to the control line 124, which may place the implosion chamber 204 in fluid communication with the low-pressure source. In other embodiments, however, the conduit 218 may be in fluid communication with a local (i.e., downhole) low-pressure source that otherwise forms an integral part of the tool string 114 (FIG. 1).

At or near the second end 202*b* of the housing 200, the device 116 may further include a frangible member 210 and an actuation device 212. In the illustrated embodiment, the frangible member 210 may be fixedly attached to the interior of the implosion chamber 204 and may be any device or mechanism configured to rupture, break, or otherwise fail upon assuming a load delivered by the actuation device 212. For example, the frangible member 210 may be, but is not limited to, a burst disc, a rupture disc, a burst diaphragm, a blowout panel, or any other intentionally weak structure known to those skilled in the art. The frangible member 210 may be made of a variety of materials including, but not limited to, plastics, ceramics, metals, composite materials, elastomers and rubbers, and any combination thereof.

The frangible member 210 may be configured to sealingly engage the inner wall(s) of the implosion chamber 204. As a result, fluids are generally prevented from traversing the frangible member 210 in either axial direction within the implosion chamber 204 until the frangible member 210 is ruptured using the actuation device 212.

The actuation device 212 may be arranged at or near the second end 202*b* and may be any device or mechanism configured to rupture or break the frangible member 210. In some embodiments, as illustrated, the actuation device 212 may include an extendable rod 214 configured to axially translate within the implosion chamber 204 once the actuation device 212 is properly actuated or otherwise triggered. In at least one embodiment, a piercing member 216 may be disposed on the distal end of the extendable rod 214 and configured to engage and pierce (i.e., break, rupture, etc.) the frangible member 210. The piercing member 216 may be an integral part of the extendable rod 214 or may be a separate and distinct component of the device 116 fixedly attached to the distal end of the extendable rod 214. The actuation device 212 may be communicably coupled to the control line 124 such that it may be powered using hydraulics, pneumatics, or electricity and therefore may be any mechanical, electromechanical, hydraulic, or pneumatic actuation device known to those skilled in the art.

In at least one embodiment, however, the actuation device 212 may be actuated or triggered using a jarring tool (not shown) included in the tool string 114. More particularly, the jarring tool may be configured to provide an axial load to the actuation device 212 that results in the actuation device 212 being actuated or otherwise triggered. As illustrated, the actuation device 212 may further include a biasing member, such as a coil spring 219 operatively coupled to the extendable rod 214. The spring 219 may be a compression spring used to axially accelerate the extendable rod 214 and piercing member 216 toward the frangible member 210 when the actuation device 212 is actuated. The spring 219 may be held in a contracted configuration using one or more shearable devices (e.g., shear pins, shear rings, etc.) until the jarring tool is operated to convey an axial load to the shearable device(s) that results in the shearable device(s) failing or breaking. Once the shearable device(s) fail, the spring 219 may be released from its contracted configuration and therefore able to axially accelerate the extendable rod 214 and piercing member 216 toward the frangible member 210 to rupture the frangible member 210.

At or near the second end 202*b*, the housing 200 may further include or otherwise define one or more influx ports 220 (shown as one or more radial influx ports 220*a* and one or more axial influx ports 220*b*). The influx ports 220*a,b* may place the implosion chamber 204 in fluid communication with the annulus 122 of the wellbore 102 surrounding the housing 200. More particularly, the influx ports 220*a,b* may enable fluid communication between the implosion chamber 204 and the perforation channels 120 within the formation 110 (FIG. 1). While only three influx ports 220*a,b* are depicted in FIG. 2, embodiments are contemplated herein that include more or less than three influx ports 220*a,b* (including only one), without departing from the scope of the disclosure. Moreover, it is also contemplated herein to include only radial influx ports 220*a* or only axial influx ports 220*b*.

The tool string 114 may further include a control module 222 and one or more sensors 224, each being communicably coupled to the control line 124. The sensor 224 may be a pressure sensor or gauge that enables a well operator to correlate downhole pressures with wellbore depth. In another embodiment, the sensor 224 may be a casing collar locator also used to provide the well operator with wellbore depth readings. The sensor 224 may be able to communicate with the control module 222 and/or the computer 126 (FIG. 1) at the surface via the control line 124.

The control module 222 may be configured to provide the well operator with real-time downhole information, such as one or more parameters or conditions detected or measured by the sensor(s) 224. Like the computer 126, the control module 222 may include a processor and a machine-readable storage medium having instructions stored thereon, which, when executed by the processor, may perform operations in real-time or near real-time such as communicating and/or controlling the downhole tools. In certain embodiments, the control module 222 may comprise a microcontroller, in which a processor or processor core is incorporated with a memory component onto a single integrated circuit. In some embodiments, the control module 222 may additionally receive control signals from the computer 126 to operate the device 116, such as control signals used to operate the actuation device 212 or to control the flow of fluids out of the implosion chamber 204 via the fluid port 206 and associated conduit 218. Accordingly, the actuation device 212 may be controlled directly from the surface (e.g., the computer 126) or through the control module 222, or may be controlled (i.e., actuated) using an inline jarring tool, as generally described above.

In exemplary operation, the device 116 may be advanced into the wellbore 102 to a target location, such as at or near the perforation channels 120. A pressure differential may be generated across the frangible member 210 within the implosion chamber 204 either prior to introducing the device 116 downhole or otherwise once the device 116 is located at the target location. To generate the pressure differential, fluids (e.g., air, water, a hydraulic fluid, etc.) may be evacuated from the implosion chamber 204 via the fluid port 206 and associated conduit 218, thereby creating a low-pressure area within the implosion chamber 204 uphole from the frangible member 210. Since the influx ports 220*a,b* fluidly communicate with the implosion chamber 204 downhole from the frangible member 210, the pressure differential also includes pressures within the annulus 122 surrounding the device 116. With the pressure differential generated within the implosion chamber 204, the device 116 may be considered to be in a first or charged configuration, as shown in FIG. 2A.

Referring to FIG. 2B, once at the target location within the wellbore 102, the device 116 may be actuated. In some embodiments, the device 116 may be actuated by the well operator inputting a command to the computer 126 (FIG. 1). Alternatively, the device 116 may be actuated at a predetermined time via a timer implemented by or within the computer 126 or the command module 222. In a further embodiment, the device 116 may be configured to actuate once a predetermined pressure limit is sensed or otherwise detected by the sensor 224. In yet other embodiments, the device 116 may be actuated or otherwise triggered following a jar or axial impact load received from a jarring tool (not shown) associated with the tool string 114. Upon actuation, the actuation device 212 may be triggered such that the extendable rod 214 and associated piercing member 216 are driven into contact with the frangible member 210.

As indicated above, in at least one embodiment, the actuation device 212 may be any mechanical, electromechanical, hydraulic, or pneumatic actuation device powered using hydraulics, pneumatics, or electricity provided through the control line 124. Accordingly, upon receiving the requisite input signal or energy via the control line 124, the actuation device 212 may axially extend the extendable rod 214 such that the piercing member 216 is driven into contact with the frangible member 210 and thereby pierces or otherwise breaks the frangible member 210.

As also indicated above, the actuation device 212 may be actuated using a jarring tool (not shown) arranged in the tool string 114. The jarring tool may be any jarring tool known to those skilled in the art, such as a spang jar or the like. The jarring tool operates to convey an axial impact load through the tool string 114 such that the one or more shearable devices (e.g., shear pins, shear rings, etc.) used to hold the spring 219 in its contracted configuration are sheared or otherwise caused to fail. Upon the shearable devices failing, the spring 219 may be released and the spring force built up in the spring 219 drives the extendable rod 214 and the piercing member 216 toward the frangible member 210 and ruptures the frangible member 210.

Once the frangible member 210 is pierced or otherwise broken, the implosion chamber 204 will naturally seek pressure equilibrium within the housing 200. In this process, wellbore fluids within the annulus 122 are drawn into the implosion chamber 204 via the influx ports 220*a,b*, thereby generating a pressure underbalance within the annulus 122 surrounding the device 116. The pressure underbalance may serve to draw scale and debris out from the perforation channels 120 and into/toward the annulus 122, as represented by the arrows A. Some of the scale and/or debris may enter the implosion chamber 204 via the influx ports 220*a,b*. The remaining scale and/or debris may be circulated to the surface via the annulus 122 and removed from the wellbore 102.

While only one device 116 is depicted in the tool string 114 of FIGS. 2A and 2B, it will be appreciated that the tool string 114 may include more than one device 116, without departing from the scope of the disclosure. For instance, the tool string 114 may employ two or more devices 116, where each device 116 includes individual housings 200, implosion chambers 204, and associated frangible members 210 and actuation devices 212. Moreover, each device 116 used in the tool string 114 may vary in size and/or length, thereby providing varying differences in generated pressure differentials and thereby enabling a configuration of increased efficiency during downhole operations. For example, an axially longer housing 200 and/or implosion chamber 204 in one of the devices 116 may allow a greater pressure underbalance, thus having a larger impact on a targeted section of the perforation channels 120. However, an axially shorter housing 200 and/or implosion chamber 204 may act more evenly on the perforation channels 120, thus decreasing the likelihood of unwanted damage to the wellbore 102 or perforation channels 120.

The size and configuration of each device 116 included in the tool string 114 need not be the same and, in some embodiments, the tool string 114 may include sections of blank pipe or other tools interposing the several devices 116, without departing from the scope of the disclosure. In one embodiment, the devices 116 may each be actuated simultaneously. In other embodiments, however, one or more of the devices 116 included in the tool string 114 may be actuated following a time delay after the actuation of one of the other devices 116.

Figure 3A:
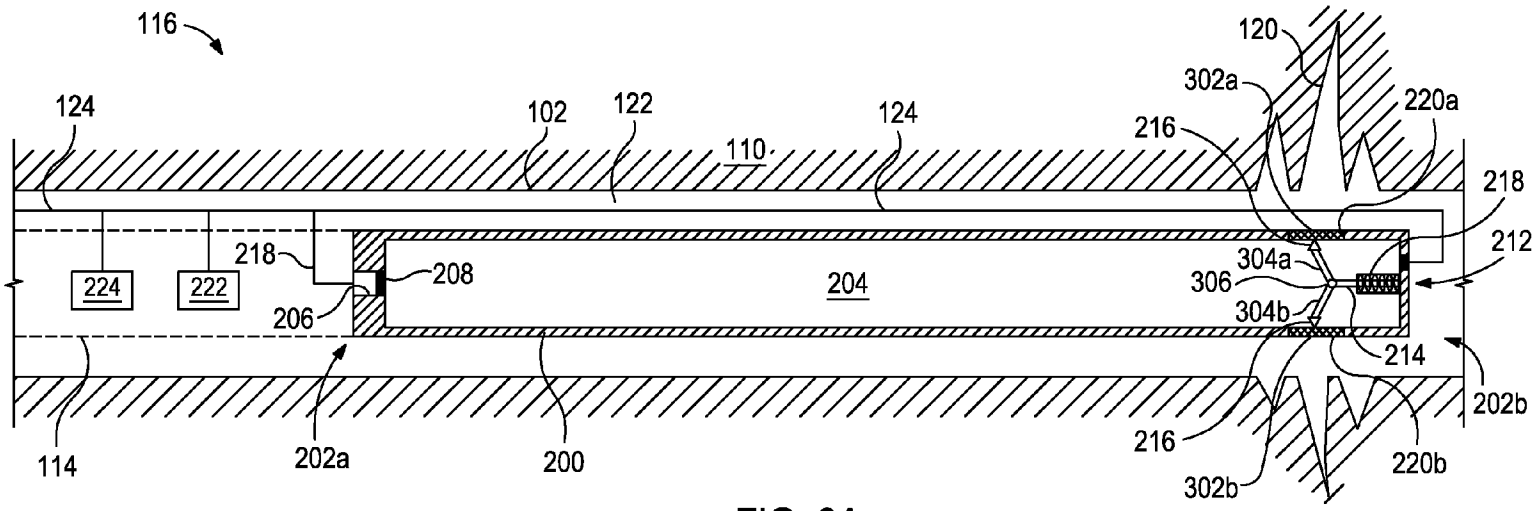
FIGS. 3A and 3B are diagrams that illustrate another embodiment of the exemplary underbalance pressure generator device of FIG. 1, according to one or more embodiments.
Figure 3B:
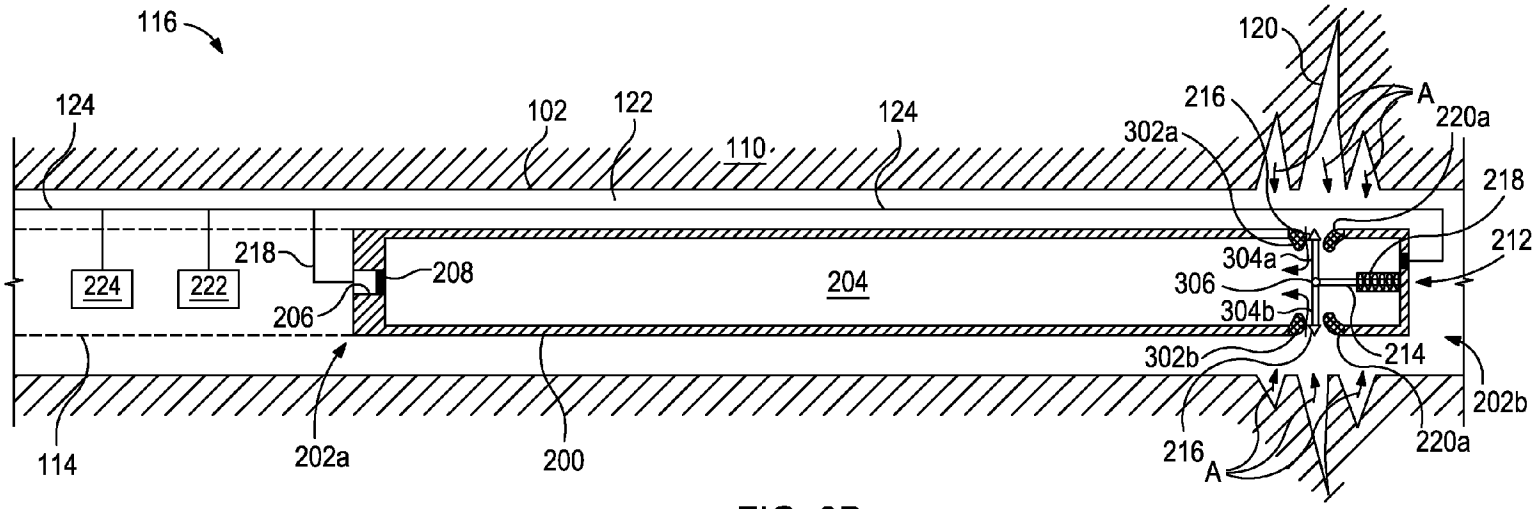

Referring now to FIGS. 3A and 3B, with continued reference to FIGS. 1 and 2A-2B, illustrated are cross-sectional side views of another embodiment of the exemplary underbalance pressure generator device 116 of FIG. 1, according to one or more embodiments. FIG. 3A shows the device 116 prior to its actuation, and FIG. 3B shows the device 116 following its actuation. The device 116 of FIGS. 3A-3B may be similar in some respects to the device 116 of FIGS. 2A-2B, and therefore may be best understood with reference thereto, where like numerals represent like components not described again. More particularly, the device 116 in FIGS. 3A-3B includes the implosion chamber 204 defined within the housing 200 between the first and second ends 202*a,b*, and the fluid port 206 and the check valve 208 are provided at or near the first end 202*a* while the actuation device 212 is arranged at or near the second end 202*b*.

The device of FIGS. 3A-3B may also include one or more frangible members 302 (shown as frangible members 302*a* and 302*b*). The frangible members 302*a,b* are depicted as being arranged or otherwise disposed within each radial influx port 220*a*. The frangible members 302*a,b* may be configured to sealingly engage the corresponding radial influx ports 220*a* and thereby generally isolate the implosion chamber 204 from fluids within the annulus 122 until the frangible members 302*a,b* are ruptured or otherwise broken using the actuation device 212. Similar to the frangible member 210 of FIGS. 2A-2B, the frangible members 302*a,b* may be any device or mechanism configured to rupture, break, or otherwise fail upon assuming a load delivered by the actuation device 212. For example, the frangible members 302*a,b* may be, but are not limited to, a burst disc, a rupture disc, a burst diaphragm, a blowout panel, or any other intentionally weak structure known to those skilled in the art. The frangible members 302*a,b* may also be made of a variety of materials including, but not limited to, plastics, ceramics, metals, composite materials, elastomers and rubbers, and any combination thereof.

The actuation device 212 depicted in FIGS. 3A-3B may include the extendable rod 214 configured to axially translate within the implosion chamber 204 once the actuation device 212 is properly actuated. The actuation device 212, however, may further include one or more radial arms 304 (shown as radial arms 304*a* and 304*b*) pivotably arranged at the distal end of the extendable rod 214 at a pivot point 306. Corresponding piercing members 216 may be disposed on the distal end of each radial arm 304*a,b* and configured to engage and pierce (i.e., break, rupture, etc.) the corresponding frangible members 302*a,b*. Accordingly, it will be appreciated that the device 116 may include an equal number of radial arms 304 and radial influx ports 202*a* such that each of the frangible members 302*a,b* included in the device 115 is properly ruptured during operation.

Those skilled in the art will readily appreciate that the actuation device 212 may incorporate various design modifications or configurations not specifically described or depicted herein and equally be operated to pierce or otherwise break the frangible members 302*a,b* in each influx port 202*a*. For instance, in at least one embodiment, the piercing members 216 or ends of the radial arms 304 may be fixedly attached to the frangible members 302*a,b*, and axial movement of the extendable rod 214 may force the radial arms 304*a,b* to pivot about the pivot point 306 (in either axial direction) and move either radially outward or radially inward. In either case, radial movement of the radial arms 304*a,b* may result in piercing, breaking, or otherwise compromising the structural integrity of the frangible members 302*a,b* such that fluid flow therethrough is enabled.

As with the prior embodiments depicted in FIGS. 2A-2B, the actuation device 212 may be any mechanical, electromechanical, hydraulic, or pneumatic actuation device powered using hydraulics, pneumatics, or electricity provided through the control line 124. In other embodiments, the actuation device 212 may alternatively be actuated or otherwise triggered following a jar or axial impact load received from a jarring tool (not shown) associated with the tool string 114.

In exemplary operation, the device 116 may be advanced into the wellbore 102 to a target location, such as at or near the perforation channels 120. A pressure differential may be generated across the frangible members 302*a,b* either prior to introducing the device 116 downhole or otherwise once the device 116 is located at the target location. To generate the pressure differential, fluids (e.g., air, water, a hydraulic fluid, etc.) may be evacuated from the implosion chamber 204 via the fluid port 206 and associated conduit 218. A low-pressure area is thereby generated within the implosion chamber 204, as compared to the pressure within the annulus 122. With the pressure differential generated across the frangible members 302*a,b*, the device 116 may be considered to be in its first or charged configuration, as shown in FIG. 3A.

Referring to FIG. 3B, once at the target location downhole, the device 116 may be actuated, for example, by the well operator inputting a command to the computer 126 (FIG. 1). Alternatively, the device 116 may be actuated at a predetermined time via a timer implemented by or within the computer 126 or the command module 222. In a further embodiment, the device 116 may be configured to actuate once a predetermined pressure limit is sensed or otherwise detected by the sensor 224. In yet other embodiments, the device 116 may be actuated or otherwise triggered following a jar or axial impact load received from a jarring tool (not shown) associated with the tool string 114. Upon actuation, the actuation device 212 may be triggered such that the extendable rod 214 and associated radial arms 304*a,b* are moved to rupture the frangible members 302*a,b*.

Upon actuation, the actuation device 212 may be triggered such that the extendable rod 214 is axially moved, and thereby radially moves the radial arms 304*a,b* as pivotably attached to the pivot point 306. In some embodiments, the radial arms 304*a,b* are moved radially outward such that the associated piercing members 216 are driven into contact with and rupture the frangible members 302*a,b*. In other embodiments, however, as indicated above, the radial arms 304*a,b* (or the piercing members 216) may be fixedly attached to the frangible members 302*a,b* and may be moved radially inward as the extendable rod 214 moves axially. Upon moving the radial arms 304*a,b* radially inward, the structural integrity of the frangible members 302*a,b* may be compromised, thereby resulting in rupturing or breaking of the frangible members 302*a,b*.

As indicated above, in at least one embodiment, the actuation device 212 may be any mechanical, electromechanical, hydraulic, or pneumatic actuation device powered using hydraulics, pneumatics, or electricity provided through the control line 124. Accordingly, upon receiving the requisite input signal or energy via the control line 124, the actuation device 212 may axially extend the extendable rod 214 such that the radial arms 304*a,b* correspondingly move and pivot about the pivot point 306 to pierce or otherwise break the frangible members 302*a,b*.

In other embodiments, however, the actuation device 212 may be actuated or otherwise triggered following a jar or axial impact load received from a jarring tool (not shown) associated with the tool string 114. The jarring tool may be configured to convey the axial impact load through the tool string 114 such that the one or more shearable devices (e.g., shear pins, shear rings, etc.) used to hold the spring 219 in its contracted configuration are sheared or otherwise fail. Upon the shearable devices failing, the spring 219 may be released and the spring force built up in the spring 219 drives the extendable rod 214 axially and correspondingly moves the radial arms 304*a,b* radially as pivotably attached to the pivot point 306.

Once the frangible members 302*a,b* are pierced or otherwise ruptured, the implosion chamber 204 will seek pressure equilibrium within the housing 200, thereby drawing wellbore fluids present within the annulus 122 into the implosion chamber 204 via the radial influx ports 220*a,b*. This results in the generation of a pressure underbalance within the annulus 122 surrounding the device 116, which serves to draw scale and debris out from the perforation channels 120 and into/toward the annulus 122, as represented by the arrows A.

Again, while only one device 116 is depicted in the tool string 114 of FIGS. 3A and 3B, it will be appreciated that the tool string 114 may include more than one device 116, without departing from the scope of the disclosure. The size and configuration of each device 116 included in the tool string 114 need not be the same and, in some embodiments, the tool string 114 may include sections of blank pipe or other tools interposing the several devices 116, without departing from the scope of the disclosure. In one embodiment, the devices 116 included in the tool string 114 may each be actuated simultaneously. In other embodiments, however, one or more of the devices 116 may be actuated following a time delay after actuation of one of the devices 116.

Figure 4A:
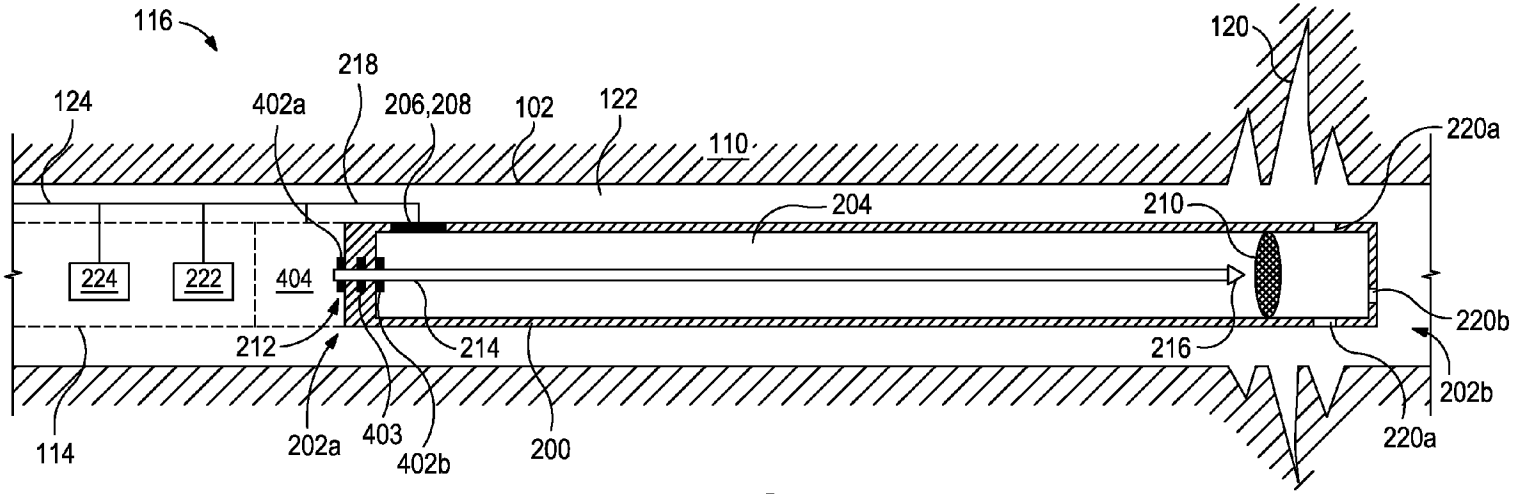
FIGS. 4A and 4B are diagrams that illustrate another embodiment of the exemplary underbalance pressure generator device of FIG. 1, according to one or more embodiments.
Figure 4B:
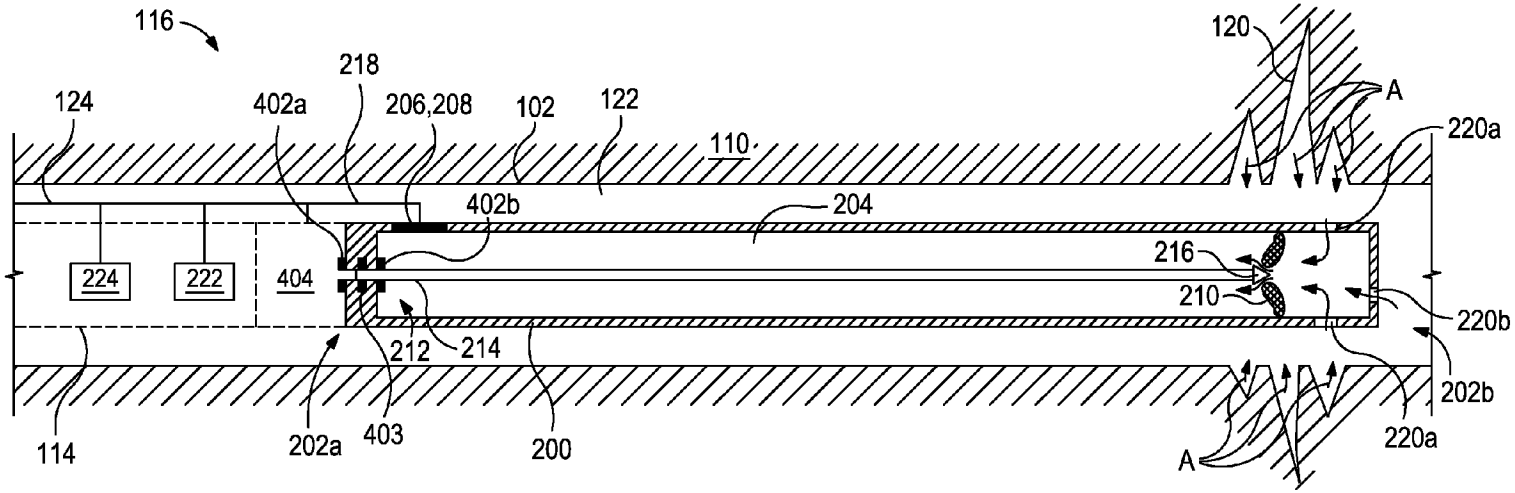

Referring now to FIGS. 4A and 4B, illustrated are enlarged cross-sectional side views of another embodiment of the underbalance pressure generator device 116 of FIG. 1, according to one or more embodiments. FIG. 4A shows the device 116 prior to its actuation, and FIG. 4B shows the device 116 following its actuation. The device 116 of FIGS. 4A-4B may be similar in some respects to the device 116 of FIGS. 2A-2B, and therefore may be best understood with reference thereto, where like numerals represent like components not described again. More particularly, the device 116 in FIGS. 4A-4B includes the implosion chamber 204 defined within the housing 200 between the first and second ends 202*a,b*, and the fluid port 206 and the check valve 208 are provided at or near the first end 202*a*. Moreover, at or near the second end 202*b* of the housing 200, the device 116 may further include the frangible member 210 configured to rupture, break, or otherwise fail upon assuming a load delivered by the actuation device 212.

In the illustrated embodiment, the actuation device 212 may include the extendable rod 214 secured to or otherwise arranged within the first end 202*a* of the housing 200. The rod 214 may be configured to axially translate within the implosion chamber 204 once the actuation device 212 is properly actuated or otherwise triggered. In at least one embodiment, the piercing member 216 may be disposed on the distal end of the extendable rod 214 and configured to engage and pierce (i.e., break, rupture, etc.) the frangible member 210. In other embodiments, the rod 214 itself may pierce the frangible member 210.

The rod 214 may be secured at the first end 202*a* of the housing 200 with one or more shearable devices 402 (shown as shearable devices 402*a* and 402*b*). The first shearable device 402*a* may be generally arranged exterior of the housing 200 and configured to fixedly attach to the rod 214 outside of the implosion chamber 204. The second shearable device 402*b* may be arranged within the implosion chamber 204 and otherwise configured to fixedly attach to the rod 214 within the housing 200. As illustrated, a portion of the proximal end of the rod 214 may extend through the first end 202*a* and one or more sealing elements 403 (one shown) may be disposed about the rod 214 at the first end 202*a* and configured to sealingly engage the rod 214. The sealing element 403 may prove advantageous in generating a sealed interface such that fluid flow out of the implosion chamber 204 at the first end 202*a* is substantially prevented.

The shearable devices 402*a,b* may be any device or mechanism configured to fail or otherwise release upon the rod 214 receiving an axial impact load sufficient to break the shearable devices 402*a,b*. In the illustrated embodiment, the shearable devices 402*a,b* are shear rings, but may equally be shear pins, or the like, without departing from the scope of the disclosure. Moreover, while two shearable devices 402 are depicted in FIGS. 4A and 4B, it will be appreciated that more or less than two shearable devices 402 may be employed, without departing from the scope of the disclosure.

In the illustrated embodiment, the tool string 114 may further include a jarring tool 404 arranged uphole from and otherwise operatively coupled to the device 116. The jarring tool 404 may be any jarring tool known to those skilled in the art, such as a spang jar, or the like. The jarring tool 404 may be actuated in order to provide an axial load to the proximal end of the rod 214 to break the shearable devices 402*a,b*, and thereby free the rod 214 for axial movement within the implosion chamber 204. In some embodiments, the jarring tool 404 may be repeatedly actuated form the surface using line tension. In other embodiments, however, the jarring tool 404 may be communicably coupled to the control line 124 and repeatedly operated using any mechanical, electromechanical, hydraulic, or pneumatic actuation device powered using hydraulics, pneumatics, or electricity provided through the control line 124.

Once the rod 214 is freed from the shearable devices 402*a, b*, the axial load assumed by the rod 214 may accelerate the rod 214 and piercing member 216 toward the frangible member 210 to rupture the frangible member 210. Once the frangible member 210 is pierced or otherwise broken, the implosion chamber 204 will naturally seek pressure equilibrium within the housing 200. In this process, wellbore fluids within the annulus 122 are drawn into the implosion chamber 204 via the influx ports 220*a,b*, thereby generating a pressure underbalance within the annulus 122 surrounding the device 116. The pressure underbalance may serve to draw scale and debris out from the perforation channels 120 and into/toward the annulus 122, as represented by the arrows A. Some of the scale and/or debris may enter the implosion chamber 204 via the influx ports 220*a,b*. The remaining scale and/or debris may be circulated to the surface via the annulus 122 and removed from the wellbore 102.

Again, while only one device 116 is depicted in the tool string 114 of FIGS. 4A and 4B, it will be appreciated that the tool string 114 may include more than one device 116, without departing from the scope of the disclosure. The size and configuration of each device 116 included in the tool string 114 need not be the same and, in some embodiments, the tool string 114 may include sections of blank pipe or other tools interposing the several devices 116, without departing from the scope of the disclosure. In one embodiment, the devices 116 included in the tool string 114 may each be actuated simultaneously. In other embodiments, however, one or more of the devices 116 may be actuated following a time delay after actuation of one of the devices 116.

Figure 5A:
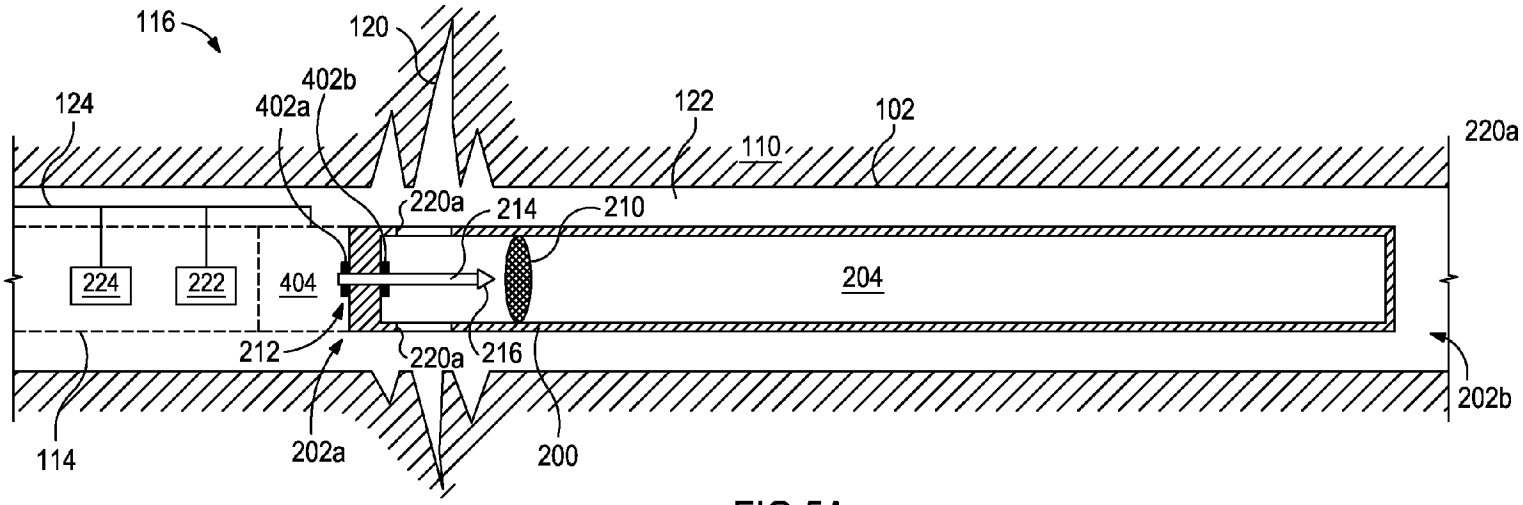
FIGS. 5A and 5B are diagrams that illustrate another embodiment of the exemplary underbalance pressure generator device of FIG. 1, according to one or more embodiments.
Figure 5B:
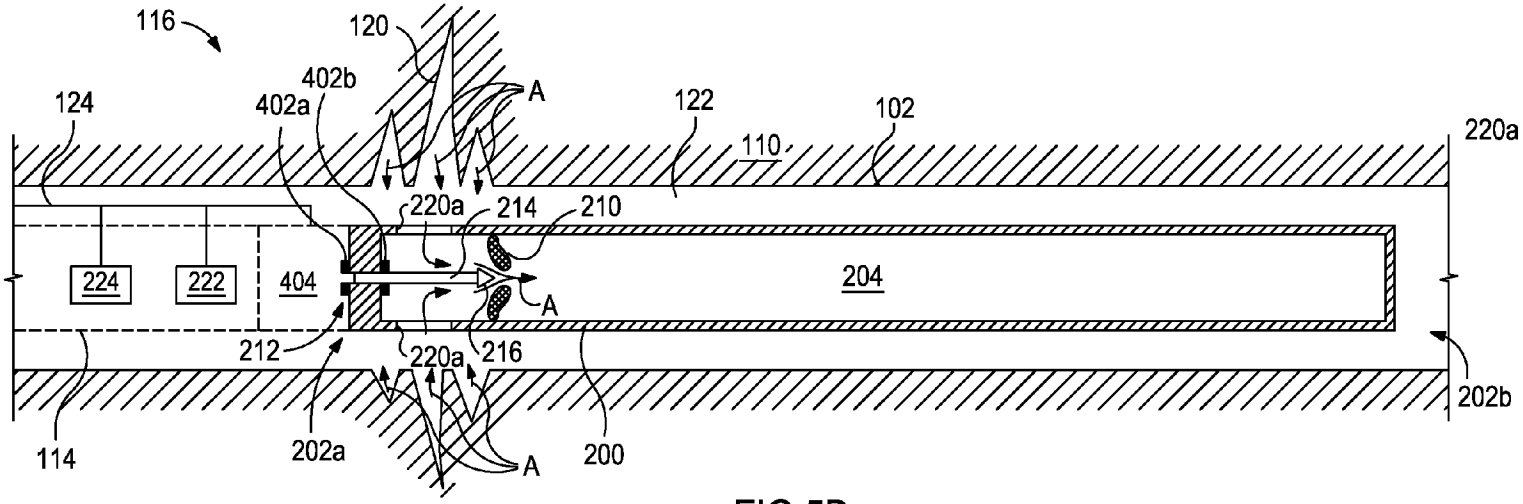

Referring now to FIGS. 5A and 5B, illustrated are enlarged cross-sectional side views of another embodiment of the underbalance pressure generator device 116 of FIG. 1, according to one or more embodiments. FIG. 5A shows the device 116 prior to its actuation, and FIG. 5B shows the device 116 following its actuation. The device 116 of FIGS. 5A-5B may be similar in some respects to the device 116 of FIGS. 4A-4B, and therefore may be best understood with reference thereto, where like numerals represent like components not described again. More particularly, the device 116 in FIGS. 5A-5B includes the implosion chamber 204 defined within the housing 200 between the first and second ends 202*a,b* and the frangible member 210 arranged within the implosion chamber 204 and configured to rupture, break, or otherwise fail upon assuming a load delivered by the actuation device 212.

Similar to the device 116 of FIGS. 4A and 4B, the actuation device 212 also includes the extendable rod 214 secured to or otherwise arranged within the first end 202*a* of the housing 200 with the one or more shearable devices 402*a,b* and may include the piercing member 216 disposed on the distal end of the extendable rod 214. One or more sealing elements 403 (one shown) may be disposed about the rod 214 at the first end 202*a* and configured to sealingly engage the rod 214. The jarring tool 404 may be arranged uphole from the device 116 and configured to provide an axial load to the proximal end of the rod 214 to break the shearable devices 402*a,b*, and thereby free the rod 214 for axial movement within the implosion chamber 204.

Unlike the device 116 of FIGS. 4A and 4B, however, the frangible member 210 and the influx ports 220*a* in FIGS. 5A and 5B may be arranged at or near the first end 202*a* of the housing 200. In exemplary operation, the device 116 may be advanced into the wellbore 102 to a target location where increased hydrocarbon productivity is desired, such as at or adjacent the pre-made or pre-perforated perforation channels 120. The jarring tool 404 may then be actuated or otherwise activated as described above in order to break the shearable devices 402*a,b* and thereby free the rod 214.

Once the rod 214 is freed from the shearable devices 402*a, b*, the axial load assumed by the rod 214 may accelerate the rod 214 and piercing member 216 toward the frangible member 210 to rupture the frangible member 210. Once the frangible member 210 is pierced or otherwise broken, the implosion chamber 204 will naturally seek pressure equilibrium within the housing 200. In this process, wellbore fluids within the annulus 122 are drawn into the implosion chamber 204 via the influx ports 220*a,b*, thereby generating a pressure underbalance within the annulus 122 surrounding the device 116. The pressure underbalance may serve to draw scale and debris out from the perforation channels 120 and into/toward the annulus 122, as represented by the arrows A. Some of the scale and/or debris may enter the implosion chamber 204 via the influx ports 220*a*. The remaining scale and/or debris may be circulated to the surface via the annulus 122 and removed from the wellbore 102.

Again, while only one device 116 is depicted in the tool string 114 of FIGS. 5A and 5B, it will be appreciated that the tool string 114 may include more than one device 116, without departing from the scope of the disclosure. The size and configuration of each device 116 included in the tool string 114 need not be the same and, in some embodiments, the tool string 114 may include sections of blank pipe or other tools interposing the several devices 116, without departing from the scope of the disclosure. In one embodiment, the devices 116 included in the tool string 114 may each be actuated simultaneously. In other embodiments, however, one or more of the devices 116 may be actuated following a time delay after actuation of one of the devices 116.

It is recognized that the various embodiments herein, such as those including the computer 126 and the control module 222, may be directed to computer control and artificial neural networks, including various blocks, modules, elements, components, methods, and algorithms, and can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Embodiments disclosed herein include:

A. An underbalance pressure generator device that includes a housing having a first end, a second end, and an implosion chamber extending between the first and second ends, one or more influx ports defined in the housing and enabling fluid communication between the implosion chamber and an exterior of the housing, at least one frangible member fixedly attached to the housing such that a pressure differential can be generated across the at least one frangible member between the implosion chamber and the exterior of the housing, and an actuation device arranged within the housing and configured to rupture the at least one frangible member upon being triggered.

B. A method that includes conveying an underbalance pressure generator device into a wellbore having one or more perforation channels defined therein, the underbalance pressure generator device including a housing defining an implosion chamber that extends between a first end and a second end of the housing and at least one frangible member fixedly attached to the housing, generating a pressure differential across the at least one frangible member between the implosion chamber and an annulus defined between the wellbore and the housing, triggering an actuation device arranged within the housing and thereby rupturing the at least one frangible member, drawing wellbore fluids into the implosion chamber via one or more influx ports defined in the housing and thereby creating a pressure underbalance in the annulus, and drawing scale and debris out of the one or more perforation channels in response to the pressure underbalance in the annulus.

Each of embodiments A and B may have one or more of the following additional elements in any combination: Element 1: further comprising a fluid port defined in the housing and configured to place the implosion chamber in fluid communication with a low-pressure source, wherein fluid is evacuated from the implosion chamber via the fluid port in order to generate the pressure differential across the at least one frangible member. Element 2: wherein the at least one frangible member is arranged in an interior of the implosion chamber. Element 3: wherein the actuation device comprises an extendable rod configured to axially translate within the implosion chamber once the actuation device is triggered, and a piercing member disposed on a distal end of the extendable rod and configured to engage and rupture the at least one frangible member. Element 4: wherein the one or more influx ports are radial influx ports and the at least one frangible member comprises a frangible member arranged in each radial influx port. Element 5: wherein the actuation device comprises an extendable rod configured to axially translate within the implosion chamber once the actuation device is triggered, and one or more radial arms pivotably arranged on the extendable rod, the one or more radial arms being configured to move radially to rupture the frangible member arranged in each radial influx port when the extendable rod moves axially. Element 6: wherein the at least one frangible member is at least one of a burst disc, a rupture disc, a burst diaphragm, and a blowout panel. Element 7: wherein the actuation device is triggered upon receiving an axial load from a jarring tool. Element 8: further comprising a control line communicably coupled to the actuation device, wherein the actuation device is a device selected from the group consisting of a mechanical actuation device, an electromechanical actuation device, a hydraulic actuation device, and a pneumatic actuation device. Element 9: further comprising one or more sensors communicably coupled to the control line and configured to determine depth of the device within a wellbore, and a control module communicably coupled to the control line and the one or more sensors and configured to communicate the depth of the device to a surface location.

Element 10: wherein generating the pressure differential across the at least one frangible member precedes conveying the underbalance pressure generator device into the wellbore. Element 11: wherein generating the pressure differential across the at least one frangible member comprises evacuating fluids from the implosion chamber via a fluid port defined in the housing. Element 12: wherein the at least one frangible member is arranged in an interior of the implosion chamber and rupturing the at least one frangible member comprises axially translating an extendable rod within the implosion chamber once the actuation device is triggered, and engaging and rupturing the at least one frangible member with a piercing member disposed on a distal end of the extendable rod. Element 13: wherein the one or more influx ports are radial influx ports and the at least one frangible member comprises a frangible member arranged in each radial influx port, and wherein rupturing the at least one frangible member comprises axially translating an extendable rod within the implosion chamber once the actuation device is triggered, radially moving one or more radial arms pivotably arranged on the extendable rod as the extendable rod axially translates, and rupturing the frangible member arranged in each radial influx port with the one or more radial arms. Element 14: wherein triggering the actuation device comprises conveying an axial load to the actuation device from a jarring tool. Element 15: wherein triggering the actuation device comprises sending one or more control signals from a computer arranged at a surface location to a control module, and operating the actuation device with the control module based on receipt of the one or more control signals. Element 16: further comprising determining a depth of the underbalance pressure generator device within the wellbore with one or more sensors communicably coupled to the control line, and communicating the depth of the underbalance pressure generator device to a surface location with a control module communicably coupled to the control line and the one or more sensors. Element 17: further comprising triggering the actuation device once a predetermined time has elapsed. Element 18: wherein the underbalance pressure generator device further includes one or more sensors, and wherein triggering the actuation device further comprises sensing a pressure within the wellbore with the one or more sensors, and triggering the actuation device once a predetermined pressure is sensed by the one or more sensors.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An underbalance pressure generator device, comprising:

a housing having a first end, a second end, and an implosion chamber defined between the first and second ends;

one or more influx ports defined in the housing and enabling fluid communication between the implosion chamber and an exterior of the housing;

at least one frangible member fixedly attached to the housing and fluidly isolating at least a portion of the implosion chamber from the exterior of the housing; and an actuation device arranged within the housing and including an extendable rod axially translatable within the implosion chamber and a piercing member coupled to the extendable rod to engage and rupture the at least one frangible member when the actuation device is triggered.

2. The device of claim 1, further comprising a fluid port defined in the housing to place the implosion chamber in fluid communication with a low-pressure source, wherein fluid is evacuated from the implosion chamber via the fluid port in order to generate a pressure differential across the at least one frangible member.

3. The device of claim 1, wherein the at least one frangible member is arranged in an interior of the implosion chamber and the piercing member disposed on a distal end of the extendable rod.

4. The device of claim 1, wherein the one or more influx ports are radial influx ports and the at least one frangible member comprises a frangible member arranged in each radial influx port, and wherein the piercing member is coupled to the extendable rod by being coupled to an end of one or more radial arms pivotably arranged on the extendable rod, the one or more radial arms being radially movable to rupture the frangible member arranged in each radial influx port when the extendable rod moves axially.

5. The device of claim 1, wherein the at least one frangible member is at least one of a burst disc, a rupture disc, a burst diaphragm, and a blowout panel.

6. The device of claim 1, wherein the actuation device is triggered upon receiving an axial load from a jarring tool.

7. The device of claim 1, further comprising a control line communicably coupled to the actuation device, wherein the actuation device is a device selected from the group consisting of a mechanical actuation device, an electromechanical actuation device, a hydraulic actuation device, and a pneumatic actuation device.

8. The device of claim 7, further comprising:

one or more sensors communicably coupled to the control line for determining depth of the device within a wellbore; and a control module communicably coupled to the control line and the one or more sensors for communicating the depth of the device to a surface location.

9. A method, comprising:

conveying an underbalance pressure generator device into a wellbore having one or more perforation channels defined therein, the underbalance pressure generator device including a housing defining an implosion chamber that extends between a first end and a second end of the housing and at least one frangible member is fixedly attached to the housing;

generating a pressure differential across the at least one frangible member;

triggering an actuation device arranged within the housing, the actuation device including an extendable rod axially translatable within the implosion chamber and a piercing member coupled to the extendable rod;

engaging and thereby rupturing the at least one frangible member with the piercing member upon triggering the actuation device;

drawing wellbore fluids into the implosion chamber via one or more influx ports defined in the housing and thereby creating a pressure underbalance in an annulus defined between the wellbore and the housing; and drawing scale and debris out of the one or more perforation channels in response to the pressure underbalance in the annulus.

10. The method of claim 9, wherein generating the pressure differential across the at least one frangible member precedes conveying the underbalance pressure generator device into the wellbore.

11. The method of claim 9, wherein generating the pressure differential across the at least one frangible member comprises evacuating fluids from the implosion chamber via a fluid port defined in the housing.

12. The method of claim 9, wherein the at least one frangible member is arranged in an interior of the implosion chamber and rupturing the at least one frangible member comprises:

axially translating the extendable rod within the implosion chamber; and engaging and rupturing the at least one frangible member with piercing member disposed on a distal end of the extendable rod.

13. The method of claim 9, wherein the one or more influx ports are radial influx ports and the at least one frangible member comprises a frangible member arranged in each radial influx port, and wherein rupturing the at least one frangible member comprises:

axially translating the extendable rod within the implosion chamber;

radially moving one or more radial arms pivotably arranged on the extendable rod as the extendable rod axially translates, wherein the piercing member is coupled to the extendable rod by being coupled to an end of the one or more radial arms; and rupturing the frangible member arranged in each radial influx port with the piercing member coupled to the one or more radial arms.

14. The method of claim 9, wherein triggering the actuation device comprises conveying an axial load to the actuation device from a jarring tool.

15. The method of claim 9, wherein triggering the actuation device comprises:

sending one or more control signals from a computer arranged at a surface location to a control module; and operating the actuation device with the control module based on receipt of the one or more control signals.

16. The method of claim 15, further comprising:

determining a depth of the underbalance pressure generator device within the wellbore with one or more sensors communicably coupled to the control line; and communicating the depth of the underbalance pressure generator device to a surface location with a control module communicably coupled to the control line and the one or more sensors.

17. The method of claim 9, further comprising triggering the actuation device once a predetermined time has elapsed.

18. The method of claim 9, wherein the underbalance pressure generator device further includes one or more sensors, and wherein triggering the actuation device further comprises:

sensing a pressure within the wellbore with the one or more sensors; and triggering the actuation device once a predetermined pressure is sensed by the one or more sensors.

* * * * *